US005900840A

United States Patent [19]

Yajima

[11] Patent Number: 5,900,840

[45] Date of Patent: May 4, 1999

[54] PLANE ANTENNA HAVING METAL/RESIN BOTTOM COVER

[75] Inventor: Hideo Yajima, Kanagawa, Japan

[73] Assignee: NGB Corporation, Tokyo, Japan

[21] Appl. No.: 08/661,738

[22] Filed: Jun. 11, 1996

[30] Foreign Application Priority Data

Jun. 20, 1995 [JP] Japan ..... 7-176555

[51] Int. Cl.[6] ..... H01Q 1/32

[52] U.S. Cl. ..... 343/713; 343/872

[58] Field of Search ..... 343/713, 715, 343/872, 700 MS

[56] References Cited

U.S. PATENT DOCUMENTS

| | | | |
|---|---|---|---|
| 3,079,289 | 2/1963 | George, Jr. et al. . | |
| 3,245,165 | 4/1966 | Podoloff | 248/683 |
| 3,633,206 | 1/1972 | McMillan | 343/754 |
| 3,910,540 | 10/1975 | Kayler | 248/206 A |
| 4,395,713 | 7/1983 | Nelson et al. | 343/713 |
| 4,398,199 | 8/1983 | Makimoto et al. | 343/700 MS |
| 4,520,364 | 5/1985 | Perry | 343/872 |
| 4,605,292 | 8/1986 | McIntosh | 350/641 |
| 4,661,821 | 4/1987 | Smith | 343/872 |
| 4,675,685 | 6/1987 | Finken | 343/708 |
| 4,851,855 | 7/1989 | Tsukamoto et al. | 343/700 MS |
| 4,878,062 | 10/1989 | Craven et al. | 343/872 |
| 4,896,165 | 1/1990 | Koizumi | 343/881 |
| 5,294,938 | 3/1994 | Matsuo et al. | 343/872 |
| 5,298,894 | 3/1994 | Cerny et al. | 340/870.02 |
| 5,355,142 | 10/1994 | Marshall et al. | 343/872 |
| 5,568,157 | 10/1996 | Anderson | 343/713 |
| 5,585,809 | 12/1996 | Yajima et al. | 343/713 |
| 5,670,745 | 9/1997 | Yajima et al. | 174/65 R |

FOREIGN PATENT DOCUMENTS

| | | |
|---|---|---|
| 61-176727 | 11/1986 | Japan . |
| 3-276904 | 12/1991 | Japan . |
| 3-726902 | 12/1991 | Japan . |
| 4-152704 | 5/1992 | Japan . |
| 6-140824 | 5/1994 | Japan . |
| 7-42210 | 7/1995 | Japan . |
| 7-42523 | 7/1995 | Japan . |
| 742214 | 7/1995 | Japan . |

*Primary Examiner*—Hoanganh Le
*Assistant Examiner*—Tan Ho
*Attorney, Agent, or Firm*—Whitham, Curtis & Whitham

[57] ABSTRACT

A plane antenna includes a resin casing including a bottom cover, and a top cover covering the upper surface of the bottom cover; and an antenna element 1*a* and circuit elements concerning thereto which are set in the resin casing. In the plane antenna, the bottom cover is formed by using a material which is prepared by mixing aluminum powder with molding resin.

17 Claims, 2 Drawing Sheets

PLANE ANTENNA HAVING METAL/RESIN BOTTOM COVER

BACKGROUND OF THE INVENTION

1. Field of the invention

This invention relates to a plane antenna for a GPS (global positioning system), and more particularly to an improvement of a resin casing which accommodates a plane antenna element.

2. Related art

As is well known in the art, a GPS plane antenna is designed as follows: That is, in order to receive radio waves from a GPS artificial satellite, the plane antenna is magnetically mounted, for instance, on the metal roof panel of an automobile. The conventional plane antenna is designed as shown, for instance, in FIG. 3

In the conventional plane antenna, as shown in FIG. 3, its antenna body 1A is made up of an antenna element 1*a*, and a circuit board 1*b* on which its relevant circuit elements are mounted. The antenna body 1A is accommodated in a water-proof and dust-proof resin casing, which is fixedly mounted on a roof panel X or the like. The resin casing is formed by injection-molding. The resin casing thus formed has a bottom cover 3A, on the outer (lower) surface of which a fixing permanent magnet 2A is fixedly mounted. After the antenna body 1A has been mounted on the inner surface of the bottom cover 3A, the bottom cover 3A (the inner surface side) is covered with a top cover 4A.

The antenna body 1A set in the resin casing be affected by its ambient electric or magnetic field. Hence, In order to prevent the antenna body 1A from being adversely affected by the ambient electric or magnetic field on the side of the roof panel X, a conductive aluminum-vapor-deposited sheet 5A, which may be used as a name plate when necessary, is bonded to the bottom of outer surface of the bottom cover 3A.

In this case, the aluminum-vapor-deposited sheet 5A, which may be the name plate as the case may be, is employed as was described above. Of course, it is necessary to specially form the aluminum-vapor-deposited sheet 5A. The sheet 5A is relatively high in manufacturing cost. In addition, since it is necessary to bond the sheet 5A to the bottom cover, the number of manufacturing steps is increased as much.

SUMMARY OF THE INVENTION

In view of the foregoing, an object of the invention is to provide a plane antenna which is prevented from being adversely affected by the ambient electric or magnetic field without use of the above-described special aluminum-vapor-deposited sheet.

The foregoing object of the invention has been achieved by the provision of a plane antenna comprising:

a resin casing including a bottom cover, and a top cover covering the upper surface of the bottom cover; and an antenna element and circuit elements concerning thereto which are set in the resin casing, in which, according to the invention, the bottom cover is formed by using a material which is prepared by mixing aluminum powder with molding resin.

DETAILED DESCRIPTION OF THE PREFERRED EMBODIMENTS

A preferred embodiment of the invention will be described with reference to FIGS. 1 and 2.

Figure 1:
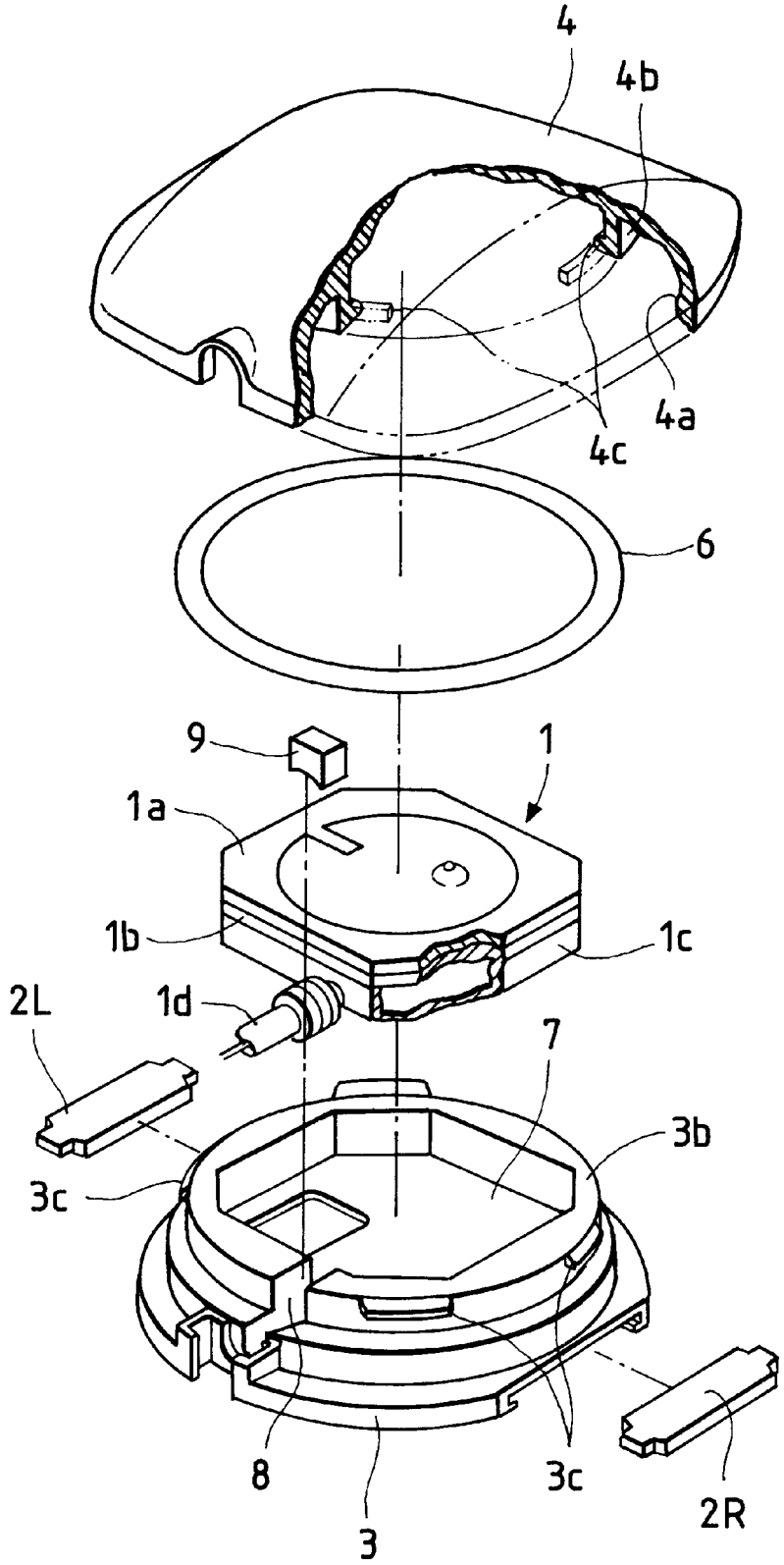
FIGS. 1 and 2 are an exploded perspective view and a sectional view, respectively, showing a plane antenna, which constitutes a preferred embodiment of the invention.
Figure 2:
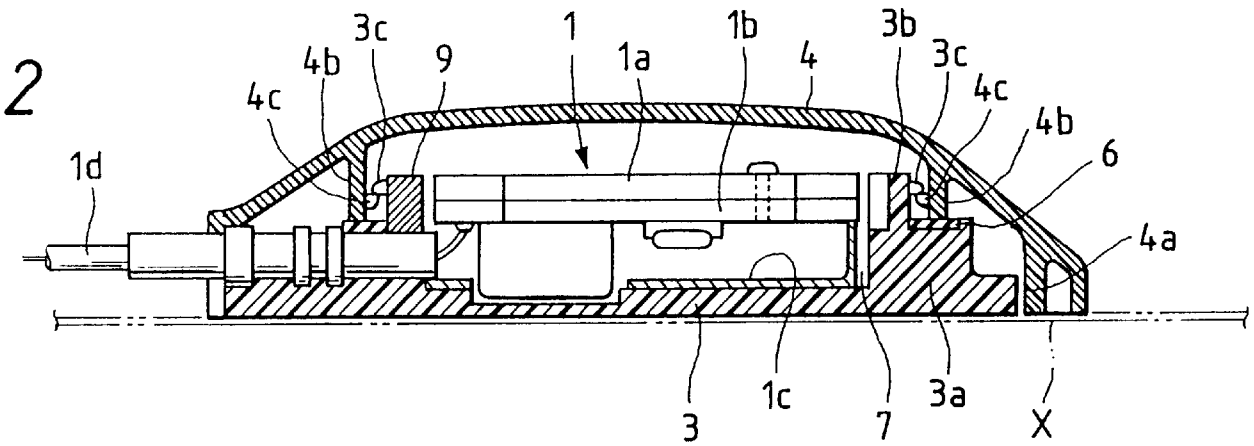
Figure 3:
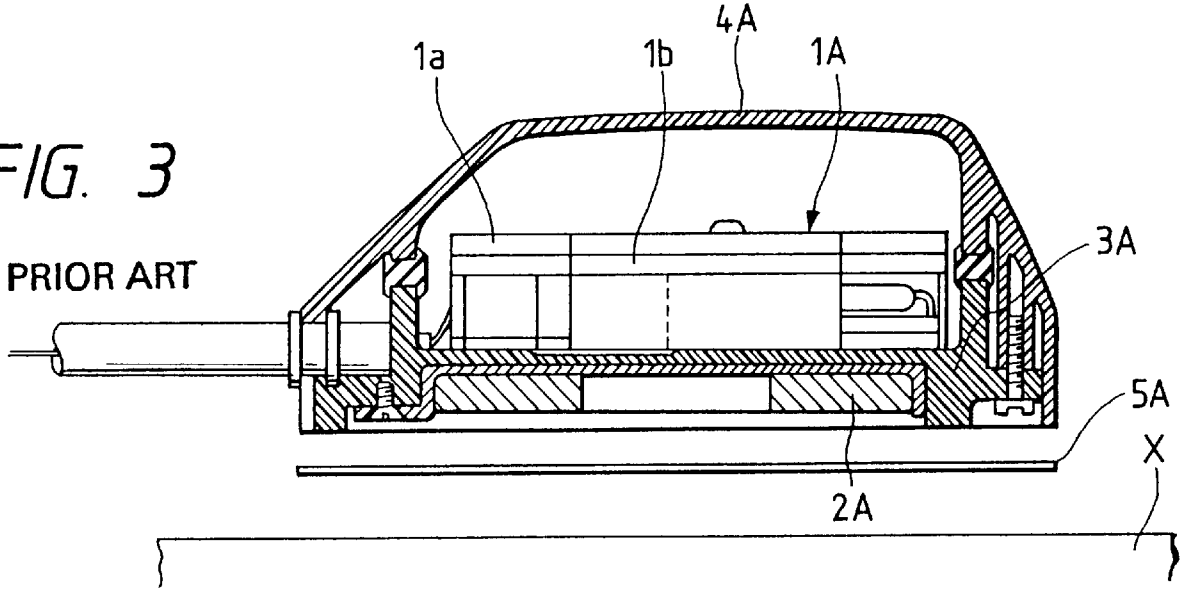
FIG. 3 PRIOR ART
FIG. 3 is a sectional view of a conventional plane antenna.

FIGS. 1 and 2 are an exploded perspective view and a sectional view, respectively, showing a plane antenna, which is the embodiment of the invention. The plane antenna comprises an antenna body 1 including an antenna element 1*a*, and a circuit board 1*b* on which its relevant circuit elements are mounted. Similarly as in the case of the conventional plane antenna, the antenna body 1 is set in a water-proof and dust-proof resin casing, which is magnetically mounted, for instance, on the roof panel X of an automobile.

As is seen from FIGS. 1 and 2, the antenna body 1 is in the form of a flat octagonal prism (block); more specifically, the bottom surface of the antenna body 1 which is confronted through the circuit board with the antenna element 1*a* is covered with a shield box 1*c*. The antenna body 1, being interposed between a bottom cover 3 and a top cover 4 (described later), is connected to the GPS (not shown) through a cable 1*d*.

The bottom cover 3 is formed by injection-molding a resin material in which aluminum powder is mixed as much as 5%. The antenna body 1 is mounted on the upper surface of the bottom cover 3 thus formed, and the bottom cover 3 is completely covered with the top cover 4. The bottom cover 3 has a bottom whose external periphery is substantially circular. The bottom of the bottom cover 3 has a pair of permanent magnets 2R and 2L at both ends, which are magnetically held on the surface of the roof panel X. On the other side of the bottom cover 3, a cylindrical seat 3*a* is formed on which a packing 6 is snugly set.

Inside the seat 3*a*, an accommodating cylinder 3*b* is formed which is extended towards the top cover 4 and has cylindrical outer surface. The cylinder 3*b* has an octagonal space 7 inside it so as to accommodate the antenna body 1 therein. In accommodating the antenna body 1 in the octagonal space 7, the cable 1*d* of the antenna body 1 is extended out of the resin casing through a groove 8 which penetrates both the seat 3*a* and the accommodating cylinder 3*b*.

On the other hand, the top cover 4 adapted to completely cover the bottom cover 3 is formed by using an ordinary molding resin containing no aluminum power so that it may not obstruct the reception of signal of the antenna element. The opening section of the top cover has a cylindrical opening 4*a* into which the cylindrical bottom cover 3 is fitted. A cylindrical protrusion 4*b* is extended from the inside of the cylindrical opening 4*a* towards the end face of the aforementioned seat 3*a*. The outer end face of the cylindrical protrusion 4*b* is pressed against the aforementioned packing 6.

A plurality of engaging pawls 4*c* are formed on the inner cylindrical surface of the cylindrical protrusion 4*b* at equal angular intervals. On the outer cylindrical surface of the accommodating cylinder 3*b* which are confronted with those engaging pawls 4*c*, a plurality of locking pawls 3*c* are formed in such a manner that they have a circumferentially inclined pitch angle so that they are engaged with the engaging pawls 4*c*, respectively.

The plane antenna designed as described above is assembled as follows: First, the antenna body 1 is set in the octagonal space 7 of the accommodating cylinder 3*a* of the bottom cover 3. Next, a wedge piece 9 is inserted into the stepped recess which is defined by the penetrating groove 8 through which the cable 1*d* of the antenna body 1 is extended. Under this condition, the packing 6 is set on the seat 3*a*, and the top cover 4 is engaged with the bottom cover 3. Thus, the plane antenna has been assembled. In other words, the antenna body 1, the wedge piece 9, and the packing 6 are combined with the bottom cover 3 as described above. With the center of the bottom cover 3 in alignment with that of the top cover 4, the cylindrical protrusion 4*b* of the top cover 4 is set on the seat 3*a* of the bottom cover 3, and the top cover 4 is turned with respect to the bottom cover 3, so that the engaging pawls 4*c* of the top cover 4 are engaged with the locking pawls 3*c* of the bottom cover. Thus, the plane antenna has been assembled as shown in FIG. 2.

The plane antenna thus constructed except for the antenna element 1*a* of the antenna body 1 is shielded from its external electric or magnetic field by the bottom cover 3 made of the material containing aluminum powder. Hence, although the plane antenna of the invention, unlike the conventional one, has no special aluminum-vapor-deposited sheet, it is prevented from being adversely affected by external electric or magnetic fields. Thus, the plane antenna of the invention is smaller in the number of components and simpler in manufacture than the conventional plane antenna.

As is apparent from the above description, in the plane antenna of the invention, its bottom cover is formed by using the material which is prepared by mixing aluminum powder with molding resin. Hence, although the plane antenna, unlike the conventional one, has no aluminum-vapor-deposited sheet, it except for the antenna element of the antenna body is completely shielded from external electric or magnetic fields. Hence, with the plane antenna of the invention, the employment of the aluminum-vapor-deposited sheet is eliminated, and the number of components is decreased as much, and the assembling work is simplified.

What is claimed is:

1. A plane antenna comprising:

a resin casing including a bottom cover having an upper surface and comprising a molding resin and an aluminum mixture where aluminum comprises approximately 5% of said resin and aluminum mixture, said resin casing further including a top cover covering the upper surface of said bottom cover and comprising resin; and a circuit board including an antenna element and circuit elements, said circuit board being positioned in said resin casing.

2. A plane antenna as in claim 1, wherein said bottom cover comprises an injected-molded resin and metal mixture.

3. A plane antenna as in claim 1, wherein said top cover substantially covers said bottom cover.

4. A plane antenna as in claim 1, wherein said bottom cover includes at least one permanent magnet.

5. A plane antenna as in claim 1, wherein said bottom cover includes a cylindrical seat and said plane antenna further comprises a packing positioned between said cylindrical seat and said top cover to seal a space between said top cover and said bottom cover.

6. A plane antenna as in claim 1, wherein said bottom cover comprises a resin and aluminum mixture and wherein aluminum comprises no more than 5% of said resin and aluminum mixture.

7. A plane antenna as in claim 1, wherein said top cover includes engaging pawls and said bottom cover includes locking pawls, wherein said engaging pawls engage said locking pawls and maintain a connection between said top cover and said bottom cover.

8. A plane antenna as in claim 1, wherein said bottom cover insulates said antenna from electromagnetic radiation and said top cover allows electromagnetic radiation to pass.

9. A cover for a plane antenna comprising:

a first resin cover; and a second cover comprising a resin and aluminum mixture where aluminum comprises approximately 5% of said resin and aluminum mixture, said second cover connecting to said first cover.

10. A cover as in claim 9, wherein said second cover comprises an injected-molded resin and metal mixture.

11. A cover as in claim 9, wherein said first cover completely covers said second cover.

12. A cover as in claim 9, wherein said second cover includes at least one permanent magnet.

13. A cover as in claim 9, wherein said second cover includes a cylindrical seat and said cover further comprises a packing positioned between said cylindrical seat and said first cover to seal a space between said first cover and said second cover.

14. A cover as in claim 9, wherein said second cover comprises a resin and aluminum mixture and wherein aluminum comprises no more than 5% of said resin and aluminum mixture.

15. A plane antenna as in claim 9, wherein said first cover includes engaging pawls and said second cover includes locking pawls, wherein said engaging pawls engage said locking pawls and maintain a connection between said first cover and said second cover.

16. A plane antenna as in claim 9, wherein said bottom cover insulates said antenna from electromagnetic radiation and said first cover allows electromagnetic radiation to pass.

17. A plane antenna comprising:

a resin case including a bottom cover and a top cover, said bottom cover comprising resin mixed with approximately 5% aluminum powder;

an antenna element being positioned within said resin case; and a circuit board having circuit elements and being positioned within said resin case.

* * * * *

UNITED STATES PATENT AND TRADEMARK OFFICE

CERTIFICATE OF CORRECTION

PATENT NO. : 5,900,840
APPLICATION NO. : 08/661738
DATED : May 4, 1999
INVENTOR(S) : Hideo Yajima It is certified that error appears in the above-identified patent and that said Letters Patent is hereby corrected as shown below:

Title page, item [73] Assignee: change "NGB Corporation, Tokyo, Japan" to read --Mitsumi Electric Co., Ltd, Tokyo, Japan--.

Signed and Sealed this

Thirtieth Day of January, 2007

JON W. DUDAS
*Director of the United States Patent and Trademark Office*